United States Patent [19]

Elsmo et al.

[11] Patent Number: 4,694,971

[45] Date of Patent: Sep. 22, 1987

[54] TAMPERPROOF PACKAGE

[76] Inventors: Thad Elsmo, 208 E. Four Mile Rd., Racine, Wis. 53402; Ronald Horvath, 4325 Kennedy Dr., #204, Racine, Wis. 53404

[21] Appl. No.: 937,739

[22] Filed: Dec. 4, 1986

[51] Int. Cl.[4] ..... B65D 39/04

[52] U.S. Cl. ..... 215/253; 215/252; 220/266

[58] Field of Search ..... 215/253, 252; 220/266

[56] References Cited

U.S. PATENT DOCUMENTS

| | | | |
|---|---|---|---|
| 3,737,064 | 6/1973 | Patel et al. | 215/42 |
| 3,892,327 | 7/1975 | Leitz | 215/253 |
| 4,452,364 | 6/1984 | Kay | 215/253 |
| 4,572,388 | 2/1986 | Luker et al. | 215/252 |
| 4,630,743 | 12/1986 | Wright | 215/216 |

*Primary Examiner*—Stephen Marcus
*Assistant Examiner*—Nova Stucker
*Attorney, Agent, or Firm*—Peter N. Jansson, Ltd.

[57] ABSTRACT

A tamper-proof package having a plurality of interacting parts on a container neck and closure which form a pair of cylindrical facing surfaces. Cooperating sets of grooves and groove-engaging frangible male members, preferably splines, are on the facing surfaces. The container has a notched flange and the closure has corresponding lugs to engage the flange. Some of the lugs are preferably frangibly connected to the closure. Observation of the splines, the lugs, and the manner of opening provide indications of tampering or the absence thereof, even though the cooperating features are shielded between the closure and the container neck.

19 Claims, 7 Drawing Figures

TAMPERPROOF PACKAGE

FIELD OF THE INVENTION

This invention is related generally to packages of the type including a container with cylindrical neck and a closure and, more particularly, to packages of this type with tamperproof mechanisms.

BACKGROUND OF THE INVENTION

For many years the public has been very concerned about tampering with packages which contain medicines, food, and the like. "Tampering" involves an unauthorized opening or invasion of a package for any purpose by someone before the purchasing consumer has opened the package for the first time for the purpose of using its contents. It is agreed that the consumer who purchases a package has a right to be confident about the amount and purity of the contents of the package—that is, that no one has tampered with it.

Considerable attention has been given for a long time to the problem of providing such confidence to consumers. However, within the last few years a number of highly publicized poisoning deaths due to undetected tampering with medicine containers and the resulting criminal investigations have greatly raised the level of concern.

Tampering can occur in many ways and on many kinds of packages. One principal type of tampering involves packages including containers having generally cylindrical necks and generally cylindrical cylindrical closures over such necks. Tampering with such packages most frequently involves an unauthorized removal of the closure, consumption or treatment of a portion of the contents, and replacement of the closure.

It is generally recognized that it may be impossible to prevent tampering. Thus, the word "tamperproof" is in a sense an overstatement; perhaps "tamper-evident" is more appropriate. In any event, the term "tamperproof" as used herein refers to the existence of means to provide an indication that a package has previously been opened and/or that an opening by the purchasing consumer is or is not the initial opening.

Many tamperproof devices have been made for containers of the type having cylindrical necks and closures, such as medicine containers and the like. There are a great number and a great variety of tamperproof characteristics, arrangements and mechanisms for containers of this type. Some of such prior tamperproof devices serve their intended purposes adequately while others have functional shortcomings.

Certain of these tamperproof devices are complex, expensive, and/or occasionally difficult to operate. Many include tear-away strips or locking members the removal of which is necessary in order to open the container. These and other tamperproof features are often external features which can detract from the appearance of the package.

There is a need for an improved tamperproof package of the type usable for medicines and the like which does not require external functional elements detracting from its appearance. There is a need for an improved tamperproof package of the type described which is simple to produce, assemble, and use.

OBJECTS OF THE INVENTION

It is an object of this invention to provide an improved tamperproof package overcoming some of the problems and shortcomings of the prior art.

Another object of this invention is to provide an improved tamperproof package for medicines and the like which is simple in construction and easy to use.

Another object of this invention is to provide an improved tamperproof package in which all tamperproof features are positioned between the container and its closure, such that they may not be observed when the packaged is closed.

Another object of this invention is to provide an improved tamperproof package of the type described which does not display its tamperproof features to a would-be tamperer.

Another object of this invention is to provide an improved tamperproof package having no external features relating to the tamperproof qualities.

Another object of this invention is to provide an improved tamperproof package providing a reliable indication of any tampering prior to initial opening by the purchasing consumer.

These and other important objects will be apparent from the descriptions of this invention which follow.

SUMMARY OF THE INVENTION

This invention is an improved tamperproof package of the type having a container, a closure, and tamperproof means. More specifically, this invention is a tamperproof container of the type having a generally cylindrical neck terminating in a lip and a closure with a cover portion and a generally cylindrical skirt depending therefrom which is sleeved over the neck such that the outside of the neck and the inside of the skirt form a pair of facing surfaces.

In the invention, a plurality of mating sets of grooves and groove-engaging male members are on the facing surfaces. Each groove is parallel to the axis of the cylindrical neck and closure. Each groove is on one of the facing surfaces and its corresponding male member is frangibly connected to the other facing member. The male members are held in the grooves and must break off as the closure is turned with respect to the neck during the initial opening motion.

A flange extends radially outwardly from the container to form the lip and has notches along it. The skirt inside surface has lugs spaced thereon which project inwardly below the lip. Such lugs have coplanar top surfaces which engage the lower surface of the lip and are rotatable with the closure into alignment with the notches during normal removal of the closure.

The mating sets of groove and groove-engaging male members and the container lip and lugs engaged therewith cooperate to provide an effective tamperproofing of the package which has all tamperproofing features completely hidden from view. The package is made tamperproof without the usual visible devices which can clutter the appearance of the package.

In highly preferred embodiments, a first subset of lugs are themselves frangibly connected to the skirt. Most perferably, every other lug is frangibly connected to the skirt and its adjacent lugs are rigidly connected to the skirt. For example, if there are four lugs, there will be two frangible lugs and two rigidly-connected lugs, and the lugs are spaced at 90 degree intervals.

The breakable connections of the frangibly connected lugs are preferably between each such lug and the skirt in a position spaced below the top of the lug, with each such lug and the skirt defining a void above the frangible link. Such void allows such lugs to be deflected outwardly when the closure is snapped over the container lip during initial assembly, after filling.

The tops of each of the lugs, both the frangibly-connected lugs and the rigidly-connected lugs, terminate in an inner edge and all lugs preferably have camming surfaces extending downwardly and outwardly from such inner edges to the skirt. Such camming surfaces facilitate initial closing of the package of this invention after filling.

In such initial closing (or "assembly"), the camming surfaces of the rigidly-connected lugs ride over and may slightly compress the container lip to a temporarily out-of-round condition before the lugs snap below the lip. The camming surface of each frangibly-connected lug also rides over the lip during original closing. Each frangibly-connected lug pivots slightly about its frangible link until it snaps back into position below the lip. As previously noted, the void adjacent to each such lug provides space for such pivoting during original assembly.

The lugs are spaced at positions around the closure skirt such that in use, after original opening of the container, the closure can be rotated to locate the lugs immediately below the notches along the container lip. In that rotational orientation the closure can be moved axially away from the container, with the lugs passing through the notches. To reclose the container, the closure is axially engaged with the container by passing the lugs through the notches until they are below the lip, and then rotated to move the lugs out of registry with the notches.

Prior to original opening of the package, when the male members are located in the grooves, the lugs are out of alignment with the notches along the lip. If the closure were removed without breaking away the male members, the lugs would have to ride over the edge of the lip.

Any attempt at such removal of the closure by force, without rotating it, with the lugs and notches out of alignment, will be resisted by the lugs. However, if the closure is in fact removed by force each frangible lug will rotate in a direction opposite its direction of rotation during initial assembly and will tear away from the skirt. The breakage will occur in the frangible link of each such lug. Any container having broken lugs should be discarded, rather than used, since the broken lugs indicate possible tampering.

Referring now to the aforementioned mating sets, the sole purpose of such mating sets is tamperproofing. During original opening by a consumer, which involves rotating the closure such that the lugs are in alignment with the notches, it is necessary to break the frangible male members away from the facing surfaces to which they are connected.

Such initial rotation of the closure with respect to the container preferably will cause a cracking sound. If such cracking sound occurs, the closure has never before been rotated with respect to the container. Provided the frangible lugs are also unbroken, the consumer can proceed with confidence to use the contents of the package.

The mating sets are preferably spaced equidistant around the facing surfaces. The male members are preferably axially parallel splines. Such splines have distal and proximal edges, and the proximal edges preferably have reduced dimensions to facilitate the breaking of the splines away from the facing surface to which they are connected.

In highly preferred embodiments, the groves are formed on the neck and the male members, most preferably splines as previously described, are formed on the skirt.

The container neck preferably has a reduced diameter portion closely adjacent to the flange lip, and the grooves terminate upwardly in end openings at such reduced diameter portion. This preferred configuration allows the male members to readily be engaged in the grooves by relative axial motion of the container and closure upon original assembly immediately after original filling. Such axial motion, earlier described, is all that is necessary for such original closing.

Upon initial opening by the consumer, the male members (preferably splines) will break off and remain loosely in the grooves until the closure is pulled away from the container. At that point, such male members will fall out, and can be discarded. Thus, the untampered condition can be noted not only be the cracking sound upon initial turning of the closure, but also by the falling out of the male members. After initial opening, the grooves serve no further purpose.

DETAILED DESCRIPTION OF PREFERRED EMBODIMENTS

Figure 2:
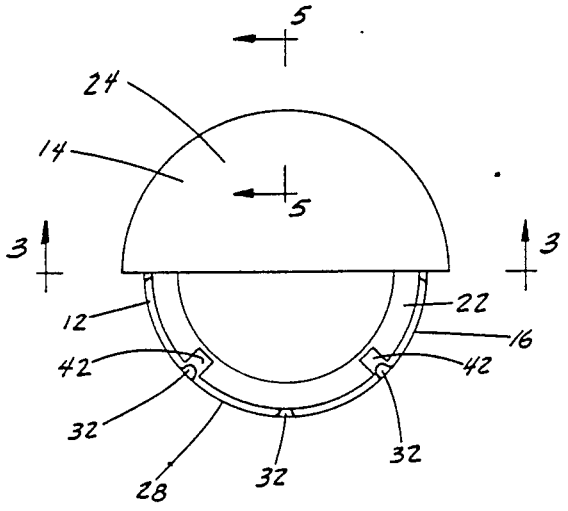
FIG. 2 is an enlarged top view of FIG. 1 with half of the closure removed to reveal portions of the bottle.
Figure 1:
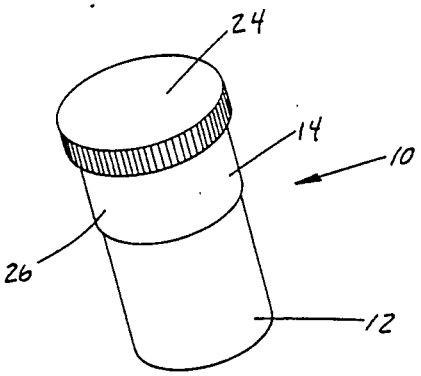
FIG. 1 is a perspective view of a preferred tamperproof container in accordance with this invention.

The figures illustrate an improved tamperproof package 10 having a container 12 and a closure 14. Container 12 and closure 14 are both cylindrical. Package 10 is of a size and shape such that it is useful for medicines such as pills, capsules, and the like.

Container 12 has a substantially cylindrical neck 16 which includes a full diameter portion 18 and a reduced diameter portion 20. Reduced diameter portion 20 terminates upwardly at a flange 22 which extends radially outwardly, with respect to the axis of the container, to form a container lip. Closure 14 includes a round cover portion 24 overlying flange 22 and a cylindrical skirt 26 depending from cover portion 24 at the peripheral edge thereof.

The outside surface 28 of neck 16 and the inside surface 30 of skirt 26, both of which are generally cylindrical, form a pair of facing surfaces which have various interacting means, as hereafter described. All of such interacting means are shielded from view by skirt 26 when package 10 is closed.

A number of grooves 32 are formed on outside surface 28 of full diameter portion 18 of neck 16. Grooves 32 are parallel to one another and parallel to the axis of cylindrical neck 16. Grooves 32 are equally spaced from one another around the periphery of neck 16. In the embodiment shown, there are eight such groove spaced at 45 degree intervals, although a different spacing and different number of grooves could be used.

For each groove 32, a spline 34 is frangibly connected to skirt inside 30 of closure 14. Splines 34 are spaced equally about skirt inside 30 and are, like grooves 32, parallel to one another and to the axis of closure 14 and neck 16. Splines 34 are intergrally formed with skirt 26.

Figure 7:
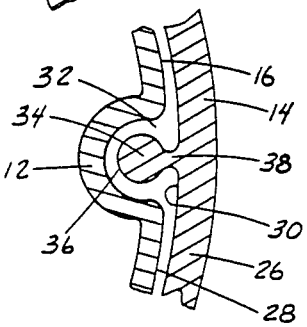
FIG. 7 is a fragmentary view of FIG. 6, further enlarged to illustrate details of a spline and spline-engaging groove.
Figure 6:
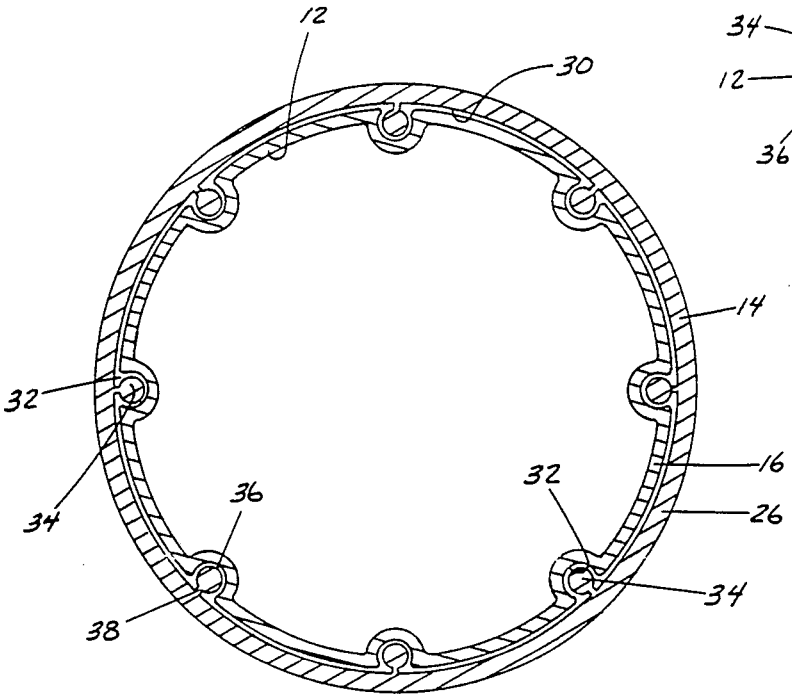
FIG. 6 is an enlarged sectional view (without background) taken along section 6—6 as indicated in FIG. 3.

Splines 34, as best illustrated in FIGS. 6 and 7, each have an enlarged distal portion 36 and a proximal portion 38. The frangible connection of each spline 34 to skirt inside 30 is along proximal portion 38. Proximal portion 38 has a reduced cross-dimension in comparison with distal portion 36. This facilitates breaking of splines 34 away from skirt inside 30, as will hereafter be described. Breakage occurs on or along proximal portions 38 by virtue of their reduced dimensions.

Each groove 32 and its corresponding spline 34 together form a mating set. In the preferred embodiment illustrated, the grooves are on outside surface 28 of container neck 16 while the splines are on skirt inside 30 of closure 14. An opposite arrangement is also acceptable, and in some embodiments some of the grooves can be on the neck of the container while others are on the skirt of the closure.

Each groove 32 extends from a lower end position on container 12 which is just covered by skirt 26 of closure 14 when tamperproof package 10 is closed upwardly to reduced diameter portion 20. Thus, each groove 32 is completely covered by closure 14 when package 10 is closed. Furthermore, grooves 32 terminate upwardly in end openings 40 (see FIG. 3) at reduced diameter portion 20 of neck 16.

End openings 40 allow splines 34 to be inserted into grooves 32 upon assembly immediately after original filling of container 12. In such assembly, closure 14 is pushed onto container 12 by relative axial motion of closure 14 with respect to container 12, without any turning of closure 14 with respect to container 12. Turning would cause breakage of splines 34.

The engagement of splines 34 in grooves 32 prevents the relative rotation of closure 14 with respect to container neck 16 unless an initial increased torque is applied to closure 14 to break splines 34 away from skirt inside 30. During normal opening and closing of container 12, as hereafter described, it is necessary to rotate closure 14 with respect to container 12 before closure 14 can be pulled axially away from container 12. Therefore, spline breakage must occur before use of the product.

As shown in FIG. 2, flange 22 has notches 42 therealong which open outwardly along the edge of the flange. Flange 22 has four such notches 42 spaced at 90 degree intervals. Notches 42 provide openings allowing passage of lugs on closure 14 during the normal opening and closing of container 12.

Around skirt inside 30 at a position spaced closely adjacent to the underside of cover portion 24 are lugs 44. Lugs 44 project radially inwardly from skirt inside 30 at a position (when engaged with container 12) below flange 22. In the embodiment shown, there are four lugs 44 spaced at 90 degree intervals around skirt inside 30.

Lugs 44 are located and shaped such that they have coplanar top surfaces 46 which engage the underside of flange 22 when container 12 is closed. Lugs 44 are fixed in their positions on closure 14 and are rotatable with closure 14 such that they come into alignment with notches 42, allowing removal of closure 14 from container 12.

Lug tops 46 terminate radially inwardly in inner edges 48 and each lug has a camming surface 50 which extends from inner edge 48 downwardly and radially outwardly to skirt inside 30. Each camming surface 50 is generally at an acute angle with respect to the axis of closure 14.

Figure 3:
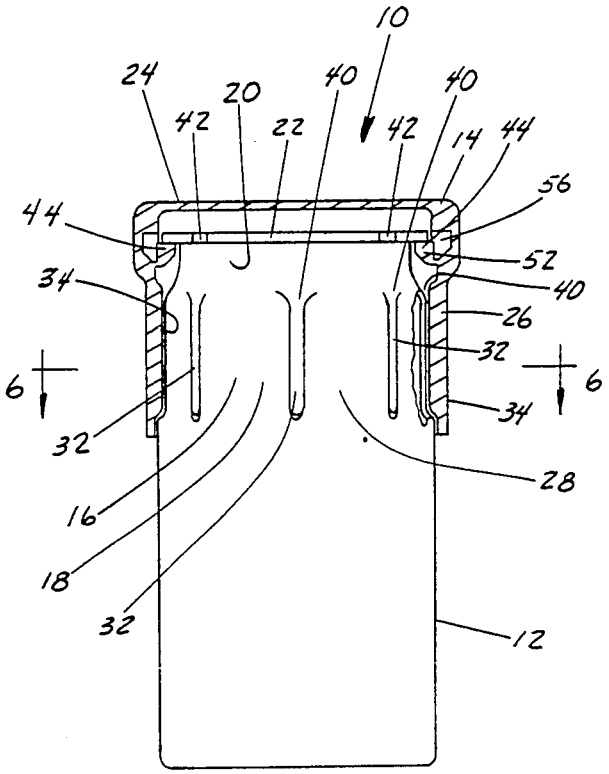
FIG. 3 is an enlarged elevation of FIG. 1 with the closure in section, taken along section 3—3 as indicated in FIG. 2.
Figure 4:
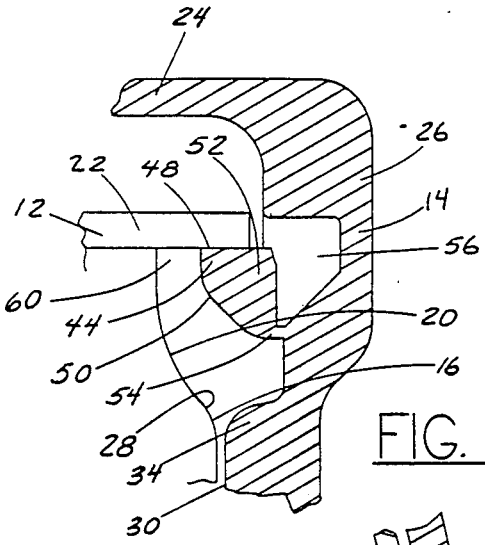
FIG. 4 is an enlarged fragmentary view of FIG. 3, showing a frangible lug engaging a portion of the container.

Two of the four lugs, which are spaced across from one another at 180 degree intervals, form a first subset of lugs 52 which are frangibly connected to skirt 26. Such frangibly-connected lugs 52 are illustrated in FIGS. 3 and 4. Frangibly-connected lugs 52 are secured to skirt inside 30 by frangible links 54, as illustrated best in FIG. 4.

Frangible links 54 join skirt inside 30 at a position spaced below lug top surfaces 46, and a void 56 is defined between each frangibly-connected lug 52 and skirt inside 30 above its frangible link 54. Voids 56 provides space accommodating outward deflection of lugs 54 during assembly of closure 14 with container 12 after initial filling.

In such assembly, closure 14 is pushed onto container 12 without any turning, with splines 34 in alignment with grooves 32 to prevent any breakage of splines 34. Therefore, during such assembly it is necessary for all the lugs to ride over flange 22 until they can snap into place below flange 22, with lug top surface 46 engaging the underside of flange 22. When the lugs are riding over flange 22, with camming surfaces 50 in contact with the outer edge of flange 22, the frangibly-connected lugs 52 pivot around their frangible links 54 into voids 56.

Figure 5:
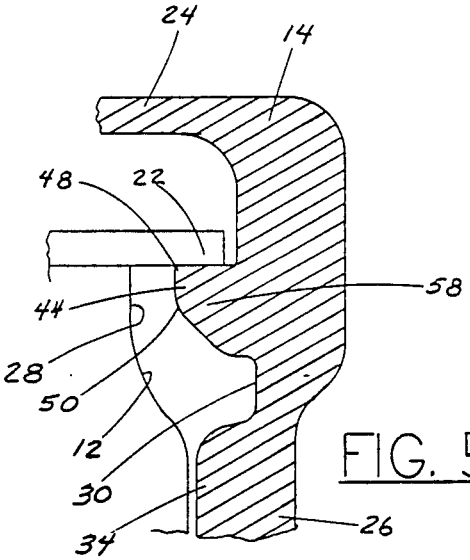
FIG. 5 is an enlarged fragmentary sectional view taken along section 5—5 as indicated in FIG. 2, illustrating a rigidly-connected lug and a portion of the container which it engages.

The two remaining lugs 58 form a second subset of lugs which are rigidly, rather than frangibly, connected to skirt inside 30. The rigidly-connected lugs 58, one of which is illustrated in FIG. 5, are across from one another and each between the frangibly-connected lugs 54.

During assembly of closure 14 with container 12, lugs 58 apply pressure onto flange 22 as they ride over it. Such pressure may cause flange 22 to go slightly out-of-round temporarily before lugs 58 clear it and snap into place beneath flange 22. Depending on the material or materials chosen for container 12 and closure 14, assembly may cause a slight degree of temporary distortion of flange 22 to allow lugs 58 to ride over it.

After package 10 has been filled and assembled in the manner just described, the proper manner of initial opening involves rotation of closure 14 until lugs 44 come into alignment with notches 42. Such rotation requires that splines 34 break away. Such breaking indicates that package 10 has never before been opened in the proper manner. The resistance to such breakage, the sound of such breakage, and the presence of the broken-away splines all indicate that such opening is the first such opening. The absence of these things indicates that package 10 has previously been opened.

If someone attempts forcefully to pull closure 14 off without turning it, frangibly-connected lugs 52 will break off. This will occur as the tops of lugs 52 engage the underside of flange 22 and are caused to rotate toward neck 16 of container 12. A space 60 is provided between lugs 58 and neck 16 accommodating such rotation. As such improper removal action continues, frangible links 54 will break, severing lugs 52 from closure 14. Thus, the absence of either or both of lugs 58 is another indication of possible tampering with package 10.

Container 12, including flange 22 and the groove-forming means, is preferably a single piece of formed plastic, although other materials can be used. Closure 12 is preferably integrally formed with lugs 44 and splines 34, using any of a variety of acceptable plastics and plastic forming methods. Numerous acceptable choices of materials would be well known to those skilled in the packaging art.

While the principles of this invention have been described in connection with specific embodiments, it should be understood clearly that these descriptions are made only by way of example and are not intended to limit the scope of the invention.

What is claimed:

1. In a package of the type having a container with a substantially cylindrical neck and a lip, a closure with a cover portion and a depending skirt sleeved over the neck, the neck outside and skirt inside forming a pair of facing surfaces, and tamperproof means, the improvement comprising:

a plurality of mating sets of grooves and groove-engaging male members on the facing surfaces, each groove axially-parallel on one facing surface and its corresponding male member frangibly connected to the other facing surface;

a flange extending radially outwardly from the container to form the lip, the flange having notches therealong; and lugs spaced around the skirt inside surface and projecting inwardly below the lip, the lugs having coplanar top surfaces engaging the lip and rotatable with the closure into alignment with the notches.

2. The package of claim 1 wherein a first subset of lugs are frangibly connected to the skirt.

3. The package of claim 2 wherein the frangible connections of the first subset lugs to the skirt comprise a frangible link between each first subset lug and the skirt at a position spaced below the lug top, each first subset lug and the skirt defining a void therebetween above the frangible link.

4. The package of claim 3 wherein the lug tops terminate in inner edges and wherein the lugs have camming surfaces extending downwardly and outwardly from the inner edges to the skirt.

5. The package of claim 4 wherein every other lug is a first subset lug.

6. The package of claim 1 wherein the mating sets are spaced around the facing surfaces.

7. The package of claim 1 wherein the male members are axially-parallel splines.

8. The package of claim 7 wherein the splines have distal and proximal portions, the proximal portions having reduced cross-dimensions to facilitate breaking of the splines from the facing surface to which they are connected upon first opening.

9. The package of claim 1 wherein the grooves are formed on the neck and the male members are formed on the skirt.

10. The package of claim 9 wherein the male members are axially-parallel splines.

11. The package of claim 10 wherein the splines have distal and proximal portions, the proximal portions having reduced cross-dimensions to facilitate breaking of the splines from the skirt upon first opening.

12. The package of claim 1 wherein:

the grooves are formed on the neck and the male members are formed on the skirt;

the neck has a reduced diameter portion adjacent to the flange; and the grooves terminate upwardly in end openings at the reduced diameter portion, whereby the male members may readily be engaged in the grooves by relative axial motion of the container and closure upon assembly immediately after original filling.

13. The package of claim 12 wherein the male members are axially-parallel splines.

14. The package of claim 13 wherein the splines have distal and proximal portions, the proximal portions having reduced cross-dimensions to facilitate breaking of the splines from the skirt upon first opening.

15. The package of claim 13 wherein a first subset of lugs are frangibly connected to the skirt.

16. The package of claim 15 wherein the frangible connections of the first subset lugs to the skirt comprise a frangible link at a position spaced below the lug top, each first subset lug and the skirt defining a void therebetween above the frangible link.

17. The package of claim 16 wherein the lug tops terminate in inner edges and wherein the lugs have camming surfaces extending downwardly and outwardly from the inner edges to the skirt.

18. The package of claim 17 wherein every other lug is a first subset lug.

19. The package of claim 18 wherein the splines have distal and proximal portions, the proximal portions having reduced cross-dimensions to facilitate breaking of the splines from the skirt upon first opening.

* * * * *